United States Patent [19]

Takenoya et al.

[11] Patent Number: 4,541,354

[45] Date of Patent: Sep. 17, 1985

[54] FEED REFERENCE POINT BALANCING DEVICE OF SEWING MACHINE

[75] Inventors: Hideaki Takenoya, Hachioji; Kazunori Honda, Kokubunji, both of Japan

[73] Assignee: Janome Sewing Machine Industry Co., Ltd., Japan

[21] Appl. No.: 595,143

[22] Filed: Mar. 30, 1984

[51] Int. Cl.[4] ..... D05B 27/22

[52] U.S. Cl. ..... 112/314; 112/220; 112/284

[58] Field of Search ..... 112/314, 284, 220, 303, 112/221

[56] References Cited

U.S. PATENT DOCUMENTS 1,543,945 6/1925 Moffatt ..... 112/314
1,543,946 6/1925 Moffatt ..... 112/314
4,196,682 4/1980 Hanyu et al. ..... 112/314 X
4,295,434 10/1981 Hsiao ..... 112/314

*Primary Examiner*—H. Hampton Hunter
*Attorney, Agent, or Firm*—William A. Drucker

[57] ABSTRACT

In a fabric feeding mechanism of a sewing machine there are provided a pair of elastic members each connected between two pivot axes at both ends of each of a pair of link elements. The elastic members have their pitches slightly different from those of the corresponding link elements and elastically displaceable in the longitudinal direction of the latter, so that backlash which may be caused at the pivot axes by abrasion resulting from repeated use of the sewing machine will be absorbed to thereby maintain a predetermined feed referenced point thereof.

3 Claims, 4 Drawing Figures

FEED REFERENCE POINT BALANCING DEVICE OF SEWING MACHINE

BACKGROUND OF THE INVENTION

This invention relates to a sewing machine in general, and more particularly to a device for automatically balancing a feed reference point of the sewing machine.

In a fabric feeding mechanism of the sewing machine, there is a predetermined feed reference point of a feed dog which will repeatedly move from the feed reference point in the forward and rearward directions to produce a number of stitches forming a specific stitch pattern design. In this connection, it will be inevitable that the repeated use of the sewing machine in a long time of period will cause the abrasion of the fabric feeding mechanism at certain parts thereof, especially at the joint parts of the interconnecting link elements through which the feed reference point is determined. As the result, the feed reference point will be displaced from an optimum position, and the pattern of stitches formed with the forward and rearward feeding will be considerably deformed. Especially, with an electronically operated sewing machine capable of storing so many data for the pattern designs to be stitched, various patterns may be produced which requires a considerable number of stitches formed with the forward and rearward feeding amounts being applied. In this case, such a displacement of the feed reference point in the feeding mechanism will greatly deform the pattern with accumulation of so many feeding errors.

SUMMARY OF THE INVENTION

This invention has been provided to eliminate the defects and disadvantages of the prior art.

It is an object of the invention to provide a feed reference point balancing device of a sewing machine for automatically maintaining the feed reference point at an optimum position, which may otherwise be displaced from the optimum position due to the abrasion of the joint parts of a fabric feeding mechanism.

Another object of the invention to provide a sewing machine which will generate substantially no mechanical noise which may otherwise be caused during the operation by the backlash due to abrasion of the joint parts of the fabric feeding mechanism.

According to the invention, therefore, there is provided a device used in combination with a sewing machine having a feed control mechanism including a feed regulator and first and second transmission links operatively connected to the feed regulator, each of the first and second transmission links having both ends each connected to an adjacent element by a pivot axis and being operated to change an angular position of the feed regulator to adjust a fabric feeding amount, the device comprising first and second elastic means each connected between the two pivot axes at both ends of each of the transmission links to normally biase the pivot axes toward each other so as to automatically balance the angular position of the feed regulator at the time of the feed amount being zero, whereby a feed reference point of the feed control mechanism may be maintained at a predetermined position.

BRIEF DESCRIPTION OF THE DRAWINGS

The other objects and advantages of the invention can be fully understood from the following detailed description when read in conjunction with the accompanying drawings in which.

PREFERRED EMBODIMENT OF THE INVENTION

Now the invention will be described in conjuction with a preferred embodiment thereof with reference to the accompanying drawings.

Figure 1:
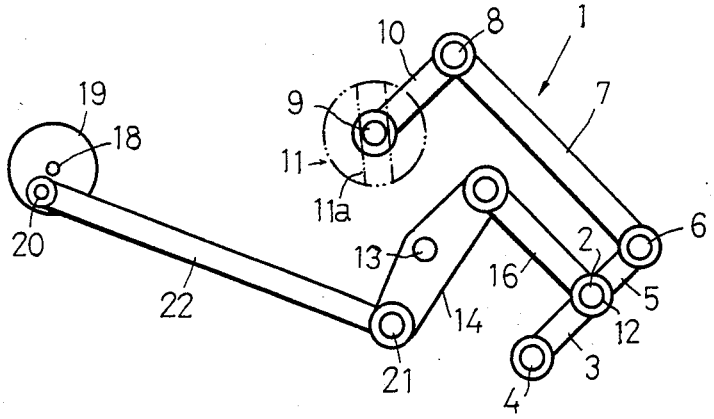
FIG. 1 is a view showing link elements of a fabric feed mechanism of a sewing machine.

As is best seen in FIG. 1, a fabric feeding mechanism 1 of a sewing machine is provided with a rotary link 3 having one end secured to a rotary shaft 2 of a feed control pulse motor (not shown) and the other end connected to a pivot axis 4, a connection link 5 having one end connected to the pivot axis 4 and the other end connected to a pivot axis 6, a first transmission link 7 having one end pivotted to the axis 6 and the other end connected to a pivot axis 8, and a swingable link 10 having one end pivotted to the axis 8 and the other end secured to a shaft 9 of a feed regulator 11 which is turnably mounted on a sewing machine housing (not shown). The feed regulator 11 is provided with a diametrically extending groove 11*a* along which an operating piece (not shown) is slided to thereby control the feeding amount as well as the feeding direction of a feed dog (not shown) in dependence upon the inclination angle of the groove 11*a*, as in a known manner. The connection link 5 is provided at the intermediate thereof with a pivot axis 12 connected to one end of a second transmission link 16, the other end of which is pivotably connected to an axis 15 positioned at one end of a connection plate 14. The connection plate 14 is at the intermediate thereof turnably mounted on an axis 13 secured to the machine housing. The connection plate 14 has the other end pivotably connected to an axis 21 to which one end of an adjusting rod 22 is coupled. The other end of the adjusting rod 22 is pivotably connected to a crankpin 20 of a crank 19 which is rotatably mounted on the machine housing by a center axis 18.

When the pulse motor is driven and the shaft 2 is rotated therewith, the link 3 is caused to swing to thereby change the position of the axis 4. Then, the connection link 5 is caused to swing about the intermediate axis 12 to thereby change the position of the axis 6. Thus, the inclination angle of the feed regulator 11 and accordingly the grooves 11*a* is changed via the links 7 and 10, to thereby vary the feeding amount or the feeding direction. Thus, the feed reference point may be automatically changed.

On the other hand, the crank 19 may be manually rotated to change the position of the pivot axis 20 to thereby change the position of the intermediate axis 12 of the link 5 via the rod 22, connection plate 14 and second transmission link 16, resulting in the change of the inclination angle of the groove 11*a* to thereby adjust the feed reference point.

Figure 3:
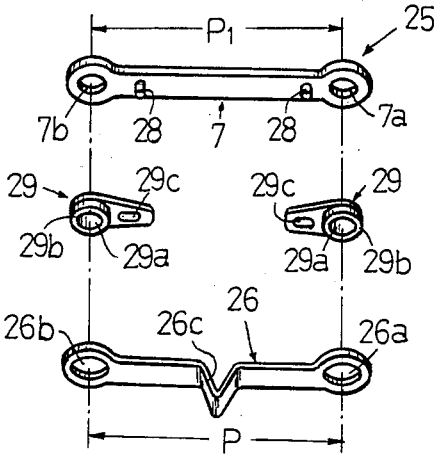
FIG. 3 is an exploded perspective view showing a feed reference point balancing device embodying the invention.
Figure 4:
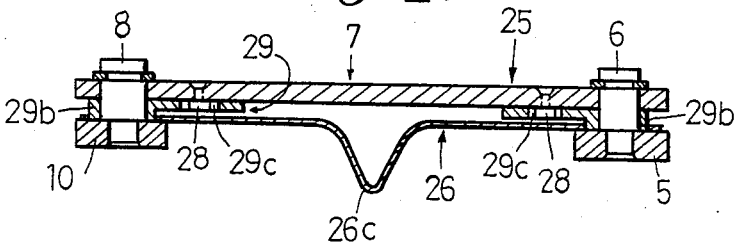
FIG. 4 is a longitudinal sectional view of the assembled structure of the feed reference point balancing device shown in FIG. 3.

The above described construction is substantially modeled on the prior art fabric feeding mechanism. According to the invention there is also provided a device 25 which is applied to the first and second transmission links 7 and 16 respectively for automatically balancing the feed reference point of the fabric feeding mechanism. The device 25 is, however, shown in FIGS. 3 and 4 only in relation to the first transmission link 7.

More particularly, the device 25 comprises an elongated elastic means 26 which is provided with holes *26a*, *26b* at both ends adapted to pass therethrough the axes 6, 8 respectively. The pitch of the elastic member 26, that is a distance between the centers of the holes *26a*, *26b* is designed to be somewhat different from the pitch of the first transmission link 7, for example the former is a little shorter than the latter. The elastic member 25 nevertheless expansible via its intermediate curved portion *26c*. Between the first transmission link 7 and the elastic member 26 there are interposed a pair of spacers 29 having holes *29a* adapted to pass therethrough the axes 6, 8 respectively, and bosses *29b* encircling the holes *29a* so as to be fitted in the holes *26a*, *26b* of the elastic member 26. The spacers 29 have laterally elongated slots *29c* each provided adjacent the holes *29a* and adapted to pass therethrough a pair of pins 28 respectively which are arranged on the first transmission link 7, so that the elastic member 26 may contract with respect to the link 7 together with the spacers 29.

Figure 2:
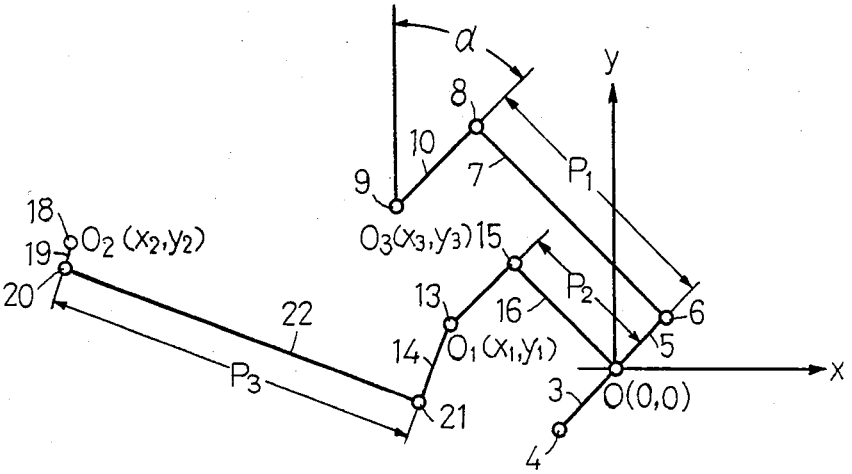
FIG. 2 is a diagram of the link elements shown in FIG. 1.

The device 25 of the invention will function as follows. FIG. 2 is a diagram of the fabric feeding mechanism 1 shown in FIG. 1. In FIG. 2, the rotary shaft 2 of the pulse motor is defined as the original coordinate O(O,O), and the stationary axes 13, 18 and 9 are defined as the coordinates $O_1(x_1, y_1)$, $O_2(x_2, y_2)$ and $O_3(x_3, y_3)$ respectively. The pitches of the first and second transmission links 7, 16 and the rod 22 are respectively defined as $P_1$, $P_2$ and $P_3$, and the angle $\alpha$ may be defined as the angle formed by the link 10 and the vertical line passing the axis 9 of the feed regulator 11 when the feeding amount is zero. Then, the variation $d\alpha$ of the feed reference point can be determined by the following equation, for example:

$$d\alpha = -0.0366\,dx_3 + 0.0378\,dy_3 - 0.0526\,dP_1 + 0.153\,dx_1 - 0.104\,dy_1 + 0.094\,dP_2 - 0.086\,dx_2 + 0.038\,dy_2 - 0.094\,dP_3 \quad \text{(I)}$$

In this equation (I), terms not including $P_1$ and $P_2$ will not be related to the variation of the feed reference point even if the relative mechanical parts suffer from abrasion and therefore may be disregarded. Only terms including $P_1$ and $P_2$ will directly influence the variation $d\alpha$. Namely, the abrasion at the relative parts of the first and second transmission links 7, 16 will directly influence the variation $d\alpha$ of the feed reference point.

If a clearance is formed between the holes *7a*, *7b* of the first transmission link 7 and the pivot axes 6, 8 due to abrasion caused by the relative movement thereof, the elastic member 26 having the pitch P a little shorter than the pitch $P_1$ of the first link 7, will contract to draw the axes 6, 8 toward each other. Then, the pitch $P_1'$ between the axes 6, 8 will become shorter than the original pitch $P_1$ of the first link 7. Similarly, the pitch $P_2'$ between the axes 12, 15 of the second link 16 will become shorter than the original pitch $P_2$ of the second link 16.

Then, $dP_1$ and $dP_2$ in the equation (I) will be negative and the values $(-0.526\,dP_1)$ and $(+0.094\,dP_2)$ are offset each other to thereby substantially maintain the value of $d\alpha$ constant.

According to the invention, therefore, the possible abrasion of mechanical parts will not result in the change of the feed reference point of the fabric feeding mechanism, whereby deformation of pattern designs, which may otherwise be produced, can be effectively avoided. The elastic member 26 will absorb the backlash between the axis and the corresponding hole of the link element, which substantially prevents generation of mechanical noise.

While the invention has been described in conjunction with a specific embodiment thereof, it is to be understood that many different modifications and variations may be made without departing from the spirit and scope thereof.

What is claimed:

1. Device used in combination with a sewing machine having a feed control mechanism including a feed regulator and first and second transmission links operatively connected to said feed regulator, each of said first and second transmission links having both ends each connected to an adjacent element by a pivot axis and being operated to change an angular position of said feed regulator to adjust a fabric feeding amount, the improvement of which comprises first and second elastic means each connected between said two axes at both ends of each of said transmission links to normally bias said pivot axes toward each other so as to automatically balance the angular position of said feed regulator at the time of the feed amount being zero, whereby a feed reference point of said feed control mechanism may be maintained at a predetermined position.

2. Device as defined in claim 1, wherein said first transmission link has one end operatively connected to said feed regulator and the other end operatively connected to a pulse motor, so that said first transmission link may be automatically operated to change the angular position of said feed regulator.

3. Device as defined in claim 1, wherein said second transmission link has one end operatively connected to said first transmission link and the other end operatively connected to a manually operated part, so that said second transmission link may be manually operated to change the angular position of said feed regulator.

* * * * *